US012638238B2

(12) United States Patent
Rodrigues et al.

(10) Patent No.: US 12,638,238 B2
(45) Date of Patent: May 26, 2026

(54) METHOD AND APPARATUS FOR LIQUEFYING A GAS RICH IN CARBON DIOXIDE

(71) Applicant: L'Air Liquide, Societe Anonyme pour l'Etude et l'Exploitation des Procedes Georges Claude, Paris (FR)

(72) Inventors: Guillaume Rodrigues, Champigny sur Marne (FR); Laurette Madelaine, Champigny sur Marne (FR); Michael Tran, Champigny sur Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 228 days.

(21) Appl. No.: 18/290,045

(22) PCT Filed: May 4, 2022

(86) PCT No.: PCT/EP2022/062037
§ 371 (c)(1),
(2) Date: Nov. 9, 2023

(87) PCT Pub. No.: WO2022/238212
PCT Pub. Date: Nov. 17, 2022

(65) Prior Publication Data

US 2024/0255218 A1 Aug. 1, 2024

(30) Foreign Application Priority Data

May 12, 2021 (FR) ..... 2105037

(51) Int. Cl.
*F25J 1/00* (2006.01)
*F25J 1/02* (2006.01)

(52) U.S. Cl.
CPC ..... *F25J 1/0027* (2013.01); *F25J 1/0045* (2013.01); *F25J 1/0202* (2013.01); *F25J 1/0274* (2013.01);
(Continued)

(58) Field of Classification Search
CPC ..... F25J 1/0027; F25J 1/0045; F25J 1/0202; F25J 1/0254; F25J 1/0274; F25J 2220/82;
(Continued)

(56) References Cited

U.S. PATENT DOCUMENTS 5,724,805 A * 3/1998 Golomb ..... F02C 6/06 60/39.463
5,974,829 A 11/1999 Novak et al.
(Continued)

OTHER PUBLICATIONS

International Search Report and Written Report for PCT/EP2022/062037, mailed Sep. 9, 2022.
(Continued)

*Primary Examiner* — Filip Zec
(74) *Attorney, Agent, or Firm* — Justin K. Murray

(57) ABSTRACT

A method for liquefying a CO2-rich gas flow containing at least 90 mol % of CO2 involves the following steps: compressing the CO2-rich gas flow, liquefying and separating in order to produce a first liquid flow at a first pressure MP and a first temperature T1. Extracting part of the first liquid flow at the first pressure and the first temperature by way of first product, supercooling part of the first liquid flow down to a temperature below the first temperature by indirect exchange of heat in a heat exchanger, expanding the liquid supercooled down to the second temperature T2 until it reaches a second pressure lower than the first pressure, the second pressure being equal to or greater than the equilibrium pressure of the expanded liquid, and extracting part of the expanded liquid by way of second product and evapo-
(Continued)

rating another part of the liquid in the heat exchanger by exchange of heat with the part of the first flow in order to produce a vaporized liquid.

19 Claims, 4 Drawing Sheets

(52) U.S. Cl.
CPC ..... *F25J 2220/82* (2013.01); *F25J 2290/34* (2013.01)

(58) Field of Classification Search
CPC ..... F25J 2240/40; F25J 2245/90; F25J 2290/34; F25J 2290/62
See application file for complete search history.

(56) References Cited

U.S. PATENT DOCUMENTS

| | | | | |
|---|---|---|---|---|
| 9,339,752 | B2 * | 5/2016 | Reddy | B01D 7/02 |
| 9,423,174 | B2 * | 8/2016 | Northrop | F25J 3/0233 |
| 9,726,375 | B2 * | 8/2017 | Stallmann | F23J 15/006 |
| 9,726,426 | B2 * | 8/2017 | Butts | H04L 67/303 |
| 9,776,132 | B2 * | 10/2017 | Enis | B01D 53/73 |
| 9,989,305 | B2 * | 6/2018 | Mak | F25J 3/0242 |
| 10,670,334 | B2 * | 6/2020 | De | F25J 3/066 |
| 10,677,160 | B2 * | 6/2020 | Sundaram | F02C 9/16 |
| 10,866,022 | B2 * | 12/2020 | Krishnamurthy | F25J 1/005 |
| 11,161,073 | B2 * | 11/2021 | Mettler | B01D 53/62 |
| 11,353,261 | B2 * | 6/2022 | Higginbotham | F25J 3/08 |
| 11,486,638 | B2 * | 11/2022 | Abarr | B01D 53/002 |
| 11,566,841 | B2 * | 1/2023 | Turney | F25J 3/0406 |
| 11,635,255 | B1 * | 4/2023 | Stiles | F25J 3/0219 62/617 |
| 12,338,740 | B2 * | 6/2025 | Baxter | B01D 53/145 |
| 2013/0118204 | A1 | 5/2013 | Higginbotham et al. | |
| 2013/0340472 | A1 | 12/2013 | De Cayeux et al. | |
| 2016/0327333 | A1 * | 11/2016 | Chambron | F25J 1/0292 |
| 2017/0176098 | A1 * | 6/2017 | Kong | F25J 3/04824 |
| 2017/0368499 | A1 * | 12/2017 | Hofer | B01D 53/226 |
| 2018/0031315 | A1 * | 2/2018 | Baxter | F23J 15/06 |
| 2020/0309451 | A1 * | 10/2020 | Abarr | F25J 3/066 |
| 2020/0318897 | A1 * | 10/2020 | Xu | F25J 3/0209 |
| 2021/0187435 | A1 * | 6/2021 | Rodrigues | B01D 53/002 |
| 2022/0090854 | A1 * | 3/2022 | Turney | F25J 1/0294 |
| 2022/0178268 | A1 * | 6/2022 | Angel | F01D 15/12 |
| 2024/0288218 | A1 * | 8/2024 | Potratz | F25J 1/0205 |
| 2024/0418437 | A1 * | 12/2024 | Zhao | F25J 1/0052 |

OTHER PUBLICATIONS

Aspelund, et al., "Gas Conditioning-The interface between CO2 capture and transport," vol. 1, No. 3, Jun. 16, 2007, pp. 343-354.

* cited by examiner

[FIG.1]
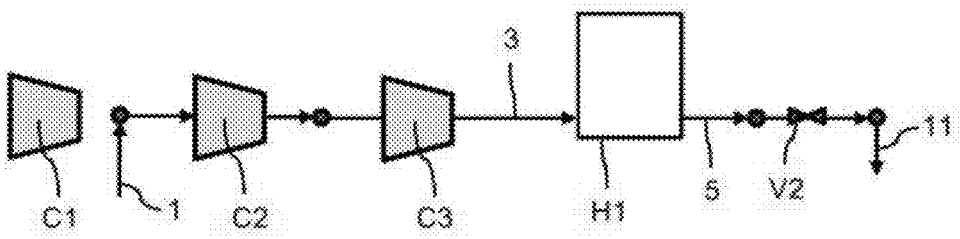
[FIG.2]
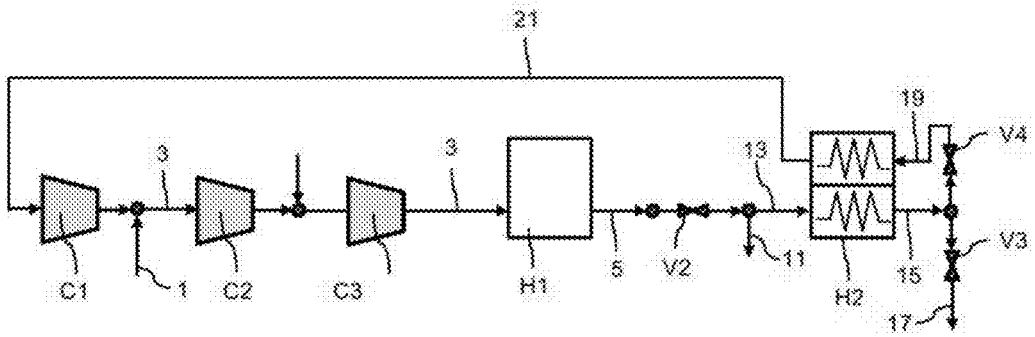

[FIG.3]
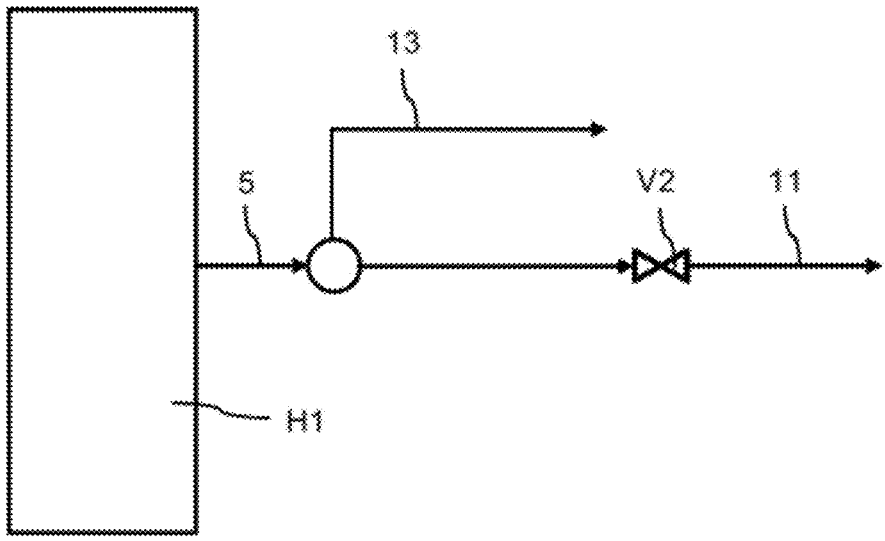
[FIG.4]
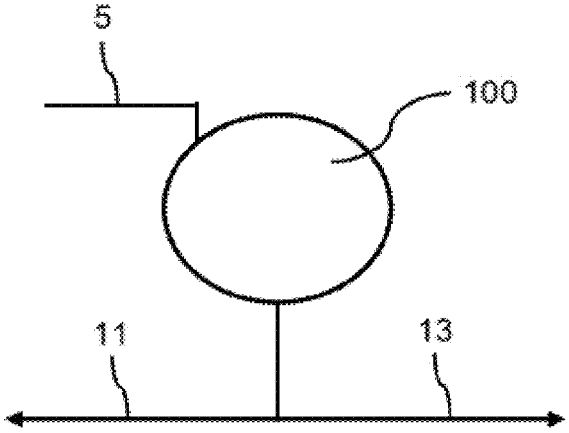

[FIG.5]
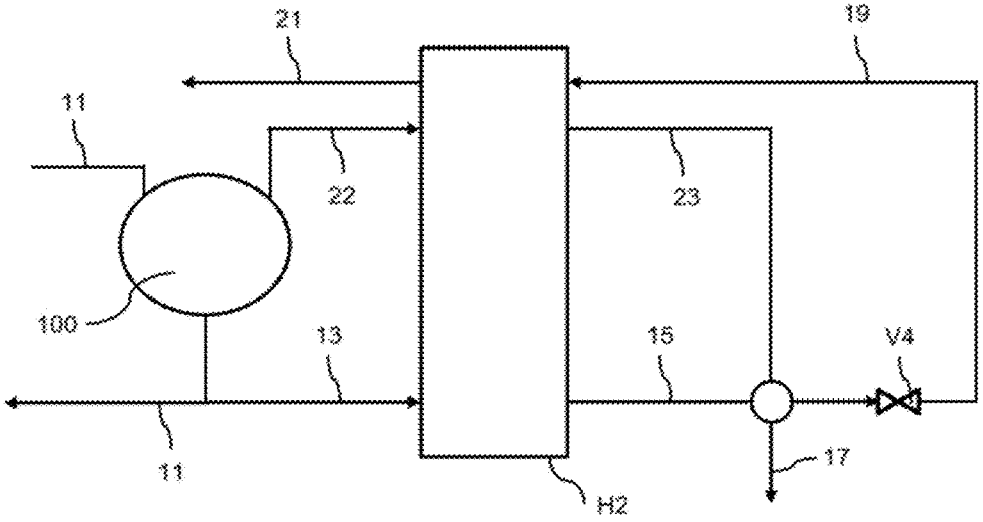
[FIG.6]
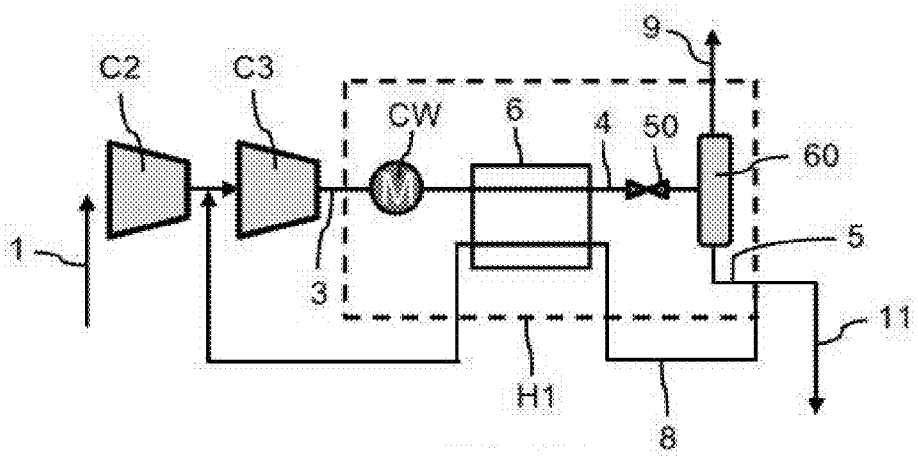

[FIG.7]
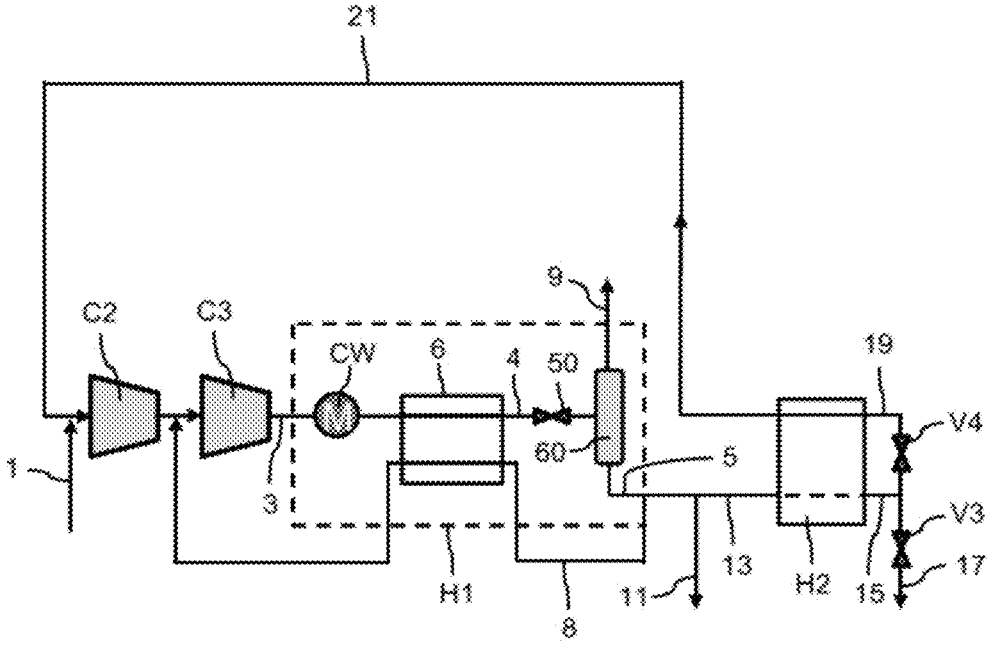

METHOD AND APPARATUS FOR LIQUEFYING A GAS RICH IN CARBON DIOXIDE

CROSS REFERENCE TO RELATED APPLICATIONS

This application is a § 371 of International PCT Application PCT/EP2022/062037, filed May 4, 2022, which claims the benefit of FR2105037, filed May 12, 2021, both of which are incorporated by reference in their entireties.

FIELD OF THE INVENTION

The present invention relates to a method and to an apparatus for liquefying a gas rich in carbon dioxide.

BACKGROUND OF THE INVENTION

Existing liquefactors produce liquid carbon dioxide at between 13 and 18 bar. Small liquefactors producing between 10 and 800 tons per day compress carbon dioxide to a pressure slightly above the pressure required for the liquid and use ammonia refrigeration units generating cold to approximately −30° C.

When carbon dioxide is required at lower pressures, different coolants can be used, using propane (to cool to −40° C.), $NH_3/CO_2$ cascades or gas mixtures.

For larger apparatuses, the preferred layouts increase the pressure to between 55 and 75 bar and liquefy the carbon dioxide with water (for example at 20° C.). The liquid carbon dioxide is then subcooled to the storage temperature. Subcooling is effected by vaporizing some of the subcooled liquid or by an external refrigeration unit.

For carbon dioxide to be transported by ship, the transport pressure is currently between 15 and 18 bar, although lower pressures are expected in the future, which will allow the ships to be bigger and make it possible to take advantage of higher liquid density.

SUMMARY OF THE INVENTION

One objective of the present invention is to propose a method for producing liquid carbon dioxide at a first pressure and a first temperature, as well as at a second pressure and a second temperature, while minimizing energy consumption and investment.

Another objective of the present invention is to propose a method for liquefying a gas rich in carbon dioxide to initially produce only a first liquid at a first pressure and a first temperature, the method being modifiable subsequently to also produce a second liquid at a second temperature lower than the first temperature and a second pressure lower than the second pressure.

In certain embodiments, this method enables an existing apparatus producing a single flow of carbon dioxide at a given pressure and a given temperature to be modified to also produce a second flow of carbon dioxide of substantially the same purity, but at a lower pressure and a lower temperature.

According to one subject of the invention, a method is provided for liquefying a gas flow rich in $CO_2$ containing at least 90 mol % of $CO_2$ comprising the following steps:

a) compression and possibly drying of the gas flow rich in $CO_2$ in a compressor;
b) liquefaction and separation by distillation and/or phase separation (60) to produce a first liquid flow at a first pressure MP and a first temperature T1;
c) extraction of a portion of the first liquid flow at the first pressure and the first temperature as a first product;
d) subcooling of a portion of the first liquid flow to a temperature below the first temperature by indirect heat exchange in a heat exchanger;
e) expansion of a portion of the subcooled liquid to a second pressure below the first pressure to form a second product;
f) expansion of the remainder of the subcooled liquid to a third pressure and vaporization of the remainder of the expanded in the heat exchanger by heat exchange with the portion of the first flow to produce a vaporized liquid, and potentially; and
g) recycling of at least a portion of the vaporized liquid flow to step (a) and/or step (b).

According to other optional aspects:

the first pressure is greater than 14 bar, preferably between 15 and 19 bar;
the first temperature is up to 5° C. less than the equilibrium temperature or equal to the equilibrium temperature;
the second pressure is equal to or less than 10 bar, preferably between 6 and 8 bar;
the second temperature is up to 5° C. less than the equilibrium temperature or equal to the equilibrium temperature;
vaporized gas (21) in the heat exchanger (H2) transfers cold to the gas flow rich in $CO_2$, for example during the liquefaction and/or distillation step (H1);
the heat exchanger (H2) exchanges heat between the expanded liquid and the portion of the first liquid flow only,
the compressor (C2, C3) compresses the flow rich in $CO_2$ to at least 60 bar, the flow at at least 60 bar is cooled in a second heat exchanger (6) to a temperature below 35° C. before being liquefied;
vaporized gas (21) in the heat exchanger (H2) is conveyed to a point upstream of the liquefaction of the gas flow, for example an inter-stage point of the compressor (C2, C3), which performs the compression step;
the third pressure is less than the second pressure; and/or the third pressure is between 5 and 6 bar.

According to another subject of the invention, a method is provided for modifying an apparatus for liquefying a gas flow rich in $CO_2$ containing at least 90 mol % of $CO_2$ in which an existing apparatus comprises.

a) A compressor and possibly a drying unit and means for conveying the gas flow rich in $CO_2$ to the compressor;
b) Liquefying means connected to the compressor and possibly to the drying unit to liquefy the gas flow rich in $CO_2$ and means of separation by distillation and/or phase separation to separate the liquefied gas flow to produce a first liquid flow as an end product at a first pressure MP and a first temperature T1;

and in which the apparatus is modified by adding a heat exchanger, means for conveying a portion of the first liquid flow to cool in the heat exchanger, means for expanding a first portion of the first liquid cooled in the heat exchanger and for outputting this expanded liquid as a second end product, means for expanding a second portion of the first cooled liquid, separately from the first portion of the first liquid, connected to the heat exchanger to enable a heat exchange between the first liquid and the portion of the first expanded liquid.

According to other optional aspects:

- the apparatus comprises means for conveying at least some of the portion of the heated expanded first liquid in the heat exchanger to the compressor or to another compressor to be compressed,
- a dedicated compressor (C1) compresses the heated expanded first liquid, possibly upstream of the compressor.

BRIEF DESCRIPTION OF THE DRAWINGS

The invention will be understood better from reading the following description and from studying the accompanying figures. These figures are given only by way of illustration and do not in any way limit the invention.

FIG. 1 shows an apparatus to be modified to implement a method according to the invention.

FIG. 2 shows an apparatus for implementing a method according to the invention.

FIG. 3 shows a variant of FIG. 2.

FIG. 4 shows a variant of FIG. 2.

FIG. 5 shows a variant of FIG. 4.

FIG. 6 shows an apparatus to be modified to implement a method according to the invention.

FIG. 7 shows an apparatus for implementing a method according to the invention.

DETAILED DESCRIPTION OF THE INVENTION

FIG. 1 shows an apparatus used to liquefy a flow rich in carbon dioxide that can produce a single product 11 at a first pressure and a first temperature. The first pressure is preferably greater than 14 bar, preferably between 15 and 19 bar.

The first temperature is up to 5° C. less than the equilibrium temperature or equal to the equilibrium temperature.

A gas 1 containing at least 80 mol %, preferably at least 95 mol %, of carbon dioxide as well as impurities, such as carbon monoxide, nitrogen or oxygen, is compressed in the first portion C2 of a compressor, comprising at least one stage. Said gas is subsequently compressed in the second portion C3 of the compressor, comprising at least one stage, to reach a pressure greater than the critical pressure.

The gas 3 is liquefied and separated in a unit H1, for example by distillation and/or by partial condensation in a phase separator to eliminate light and/or heavy impurities in the gas 1, 3. The formed liquid 5 is expanded in a valve V2 to form the product 11.

The compressor C1 may be used as required to meet product specifications and expected yield, and is provided upon installation of the apparatus in FIG. 2 with a view to future modification. This compressor C1 can be the first stage of a compressor C1, C2, C3 or can be a standalone compressor.

FIG. 2 shows how the apparatus in FIG. 1 is modified to enable the production of a second product 17 at a second pressure below the first pressure and at a second temperature, preferably from the same feed flow. The second pressure is preferably equal to or less than 10 bar, for example between 6 and 8 bar.

The second temperature is preferably up to 5° C. less than the equilibrium temperature or equal to the equilibrium temperature.

The liquid expanded in the valve V2 is separated into two, with one portion forming the first product 11 and the remainder 13 being conveyed to a heat exchanger H2 using indirect heat exchange, for example a plate-and-fin heat exchanger made of brazed aluminum.

The liquid 13 is cooled in the exchanger H2 to form a subcooled liquid 15, which is expanded in a valve V3 to form the product 17.

A portion of the subcooled liquid 15 is expanded in a valve V4 to be cooled in order to provide the energy required to cool the liquid 13 during vaporization in H2. The formed flow 21 is returned to the compressor C1. The formed flow is then mixed with the gas 1 and is further compressed in stages C2, C3.

The flow 21 can be conveyed in full or in part for compression and/or liquefaction and/or separation. Some or all of the flow can also be left unrecycled.

Where recycling is provided for, the elements in FIG. 1 are dimensioned in consideration of the future modifications in FIG. 2, in particular the compressor C2, C3 is dimensioned to enable the recycled flow 21 to be possibly compressed.

FIG. 3 shows a variant of FIG. 2 in which the liquid 13 is withdrawn upstream of the valve V2 in order to optimize energy consumption and in consideration of constraints related to the technology of the exchanger H2 with two-phase fluids.

The flow 5 is thus split into two upstream of the valve V2 to form the flow 13 to be conveyed to the heat exchanger H2 and the flow 11 to be expanded in the valve V2 to form a product.

FIG. 4 is a variant of FIG. 2 in which the liquid 5 is conveyed in full to an intermediate storage unit 100 that is preferably acquired at the beginning of the life cycle of the liquefaction unit (see FIG. 1) to produce a liquid product 11 rich in $CO_2$ at a first pressure withdrawn from the storage unit 100. The liquid 13 is withdrawn from the storage unit 100 to be conveyed to H2 to produce the $CO_2$ product at a second pressure below the first pressure.

FIG. 5 is a variant of FIG. 4 that enables the vapor phase 22 at the top of the storage unit 100 to be treated if the liquid in the storage unit 100 is partially vaporized as a result of heat input or changes in equilibrium. The gas 22 is conveyed to the exchanger H2 to be cooled and liquefied to form a liquid 23 at a second pressure. This liquid 23 can be mixed with the fluid 15 to form the product or vaporized with or without the flow 19.

FIG. 6 shows an apparatus used to liquefy a flow rich in carbon dioxide that can produce a single product 11 at a first pressure and a first temperature. The apparatus is similar to FIG. 1, but does not include the compressor C1 previously provided.

Following compression, the gas 3 is cooled in a cooler CW by a refrigerant, the temperature of which is liable to change with the ambient temperature, for example air or water, to form a supercritical gas 3 with a density between 370 and 900 kg/m$^3$. The gas is cooled in a shell-and-tube or brazed-aluminum-plate heat exchanger 6 to reach a subcritical temperature, for example between 5° C. and 25° C. The formed fluid 4 is expanded in a valve 50 to a pressure between 45 and 60 bar to form a two-phase fluid that is subsequently separated in a phase separator 60.

A portion 8 of the liquid in the phase separator 60 is used to cool the first heat exchanger 6. In this example, the liquid 8 vaporizes in the exchanger 6 and is returned to the gas to be separated 1 between the two portions C2, C3 of the compressor.

Otherwise, cold can be transferred to the heat exchanger using other means, and thus the liquid 8 is not necessarily itself conveyed into the first exchanger 6.

Another portion 11 of the liquid in the phase separator 60 forms the sole product of the apparatus in this figure, at a first pressure and a first temperature.

Separation by partial condensation in the phase separator 60 can be replaced with distillation in a distillation column, the overhead gas from the distillation column containing light impurities and the bottom liquid in the column forming the portions 8, 11, including the first product.

Naturally, more complex methods using partial condensation and distillation or distillation involving several columns could be used.

The portion of the apparatus indicated as H1 is the unit H1 in FIG. 1.

FIG. 7 shows FIG. 6 modified to enable the production of a second product 17 at a second pressure below the first pressure and at a second temperature. This modification involves adding the line 13, the heat exchanger H2, the valves V3, V4, and the lines 15, 17, 19.

Thus, a portion 13 of the bottom liquid in the phase separator 60 is cooled in the heat exchanger H2 to form the cooled liquid 15. This liquid is separated into two. A portion 17 is expanded in V3 to the second pressure and the second temperature to form the second product. The remainder 19 is expanded in the valve V4 to a third pressure, lower than the second pressure, for example between 5 and 6 bar, to be cooled, is vaporized in the heat exchanger 19 to form the gas 21, and conveyed to the compressor C2.

This addition of a single module, described for FIG. 2 and FIG. 7, makes it possible to obtain a second product by slightly modifying the original layout. The heat exchanger H2, which enables an indirect heat exchange between just two fluids, is cheap and easily available, for example a plate-and-fin exchanger or a shell-and-tube exchanger.

The vaporized gas 21 can be returned to any suitable point of the method, for example upstream of the compressor C2, downstream of C2 and upstream of C3, downstream of C3 and upstream of H1 or 50 downstream of CW and upstream of 6.

Where necessary or where the equipment is not dimensioned to recover the vaporized gas 21, a dedicated compressor C4 (not shown) can similarly be added to compress the gas 21 to a suitable pressure to be injected back into a suitable point of the method.

The flow 21 can be conveyed in full or in part for compression and/or liquefaction and/or separation. Some or all of the flow can also be left unrecycled.

Where recycling is provided for, the elements in FIG. 6 are naturally dimensioned in consideration of the future modifications in FIG. 7, and in particular the compressor C2, C3 is dimensioned to enable the recycled flow 21 to be possibly compressed.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, or making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or about another particular value. When such a range is expressed, it is to be understood that another embodiment is from one particular value and/or to the other particular value, along with all combinations within said range.

All references identified herein are each hereby incorporated by reference into this application in their entireties, as well as for the specific information for which each is cited.

The invention claimed is:

1. A method for liquefying a gas flow rich in $CO_2$ containing at least 90 mol % of $CO_2$ comprising the following steps:

a) compressing and drying of the gas flow rich in $CO_2$ in a compressor, b) liquefying and separating by at least one of distillation or phase separation to produce a first liquid flow at a first pressure and a first temperature;

c) extracting of a portion of the first liquid flow as a first liquid product;

d) subcooling another portion of the first liquid flow to a temperature below the first temperature by indirect heat exchange in a heat exchanger to produce a subcooled liquid;

e) splitting the subcooled liquid into a second product portion and a refrigerant portion;

f) expanding the second product portion to a second pressure below the first pressure to form a second liquid product; and g) expanding the refrigerant portion to a third pressure and vaporizing the expanded refrigerant portion in the heat exchanger by heat exchange with said another portion of the first liquid flow to produce a vaporized liquid.

2. The method as claimed in claim 1, wherein the first pressure is greater than 14 bar.

3. The method as claimed in claim 1, wherein the first temperature is up to 5° C. less than the equilibrium temperature or equal to the equilibrium temperature.

4. The method as claimed in claim 1, wherein the second pressure is equal to or less than 10 bar.

5. The method as claimed in claim 1, wherein the second temperature is up to 5° C. less than the equilibrium temperature or equal to the equilibrium temperature.

6. The method as claimed in claim 1, wherein vaporized gas in the heat exchanger transfers cold to the gas flow rich in $CO_2$.

7. The method as claimed in claim 1, wherein the heat exchanger exchanges heat between the expanded liquid and the portion of the first liquid flow only.

8. The method as claimed in claim 1, wherein the compressor compresses the flow rich in $CO_2$ to at least 60 bar, the flow at at least 60 bar is cooled in a second heat exchanger to a temperature below 35° C. before being liquefied.

9. The method as claimed in claim 1, wherein vaporized gas in the heat exchanger is conveyed to a point upstream of the liquefaction of the gas flow, for example an inter-stage point of the compressor, which performs the compression step.

10. The method as claimed in claim 1, wherein the third pressure is less than the second pressure.

11. The method as claimed in claim 10, wherein the third pressure is between 5 and 6 bar.

12. The method as claimed in claim 1, further comprising h) recycling at least a portion of the vaporized liquid flow to step a).

13. The method of claim 1, wherein the first liquid flow from step (b) is directed to an intermediate storage unit (100), and wherein the first liquid product is extracted from the intermediate storage unit.

14. The method of claim 13, further comprising conveying a vapor phase (22) from the intermediate storage unit (100) to the heat exchanger to be cooled and liquefied.

15. The method of claim 1, wherein the vaporized liquid in step (h) is compressed in a dedicated compressor before being recycled to step a).

16. A method for modifying an apparatus for liquefying a gas flow rich in $CO_2$ containing at least 90 mol % of $CO_2$, wherein the apparatus comprises:

a) a compressor and means for conveying the gas flow rich in $CO_2$ to the compressor b) liquefying means connected to the compressor to liquefy the gas flow rich in $CO_2$ and means of separation by distillation and/or phase separation to separate the liquefied gas flow to produce a first liquid flow as an end product at a first pressure MP and a first temperature T1;

wherein the method comprises the steps of:

adding the following components to the apparatus:

a heat exchanger, means for conveying a portion of the first liquid flow to cool in the heat exchanger, means for expanding a first portion of the first liquid cooled in the heat exchanger and for outputting said expanded liquid as a second end product, and means for expanding a second portion of the first cooled liquid, separately from the first portion of the first liquid, connected to the heat exchanger to enable a heat exchange between the first liquid and the portion of the first expanded liquid.

17. The method as claimed in claim 16, wherein the step of adding the following components to the apparatus includes adding means for conveying at least some of the portion of the heated expanded first liquid in the heat exchanger to the compressor or to another compressor to be compressed.

18. The method as claimed in claim 16, wherein a dedicated compressor compresses the heated expanded first liquid.

19. An apparatus for liquefying a gas flow rich in $CO_2$, the apparatus comprising:

a compressor configured to compress the gas flow;

a liquefaction unit fluidly connected to an outlet of the compressor, the liquefaction unit configured to produce a first liquid flow;

a first product line configured to extract a portion of the first liquid flow as a first product;

a heat exchanger;

a fluid conduit configured to convey another portion of the first liquid flow to the heat exchanger to be subcooled, thereby producing a subcooled liquid;

a splitter fluidly connected to an outlet of the heat exchanger, the splitter configured to separate the subcooled liquid into a second product portion and a refrigerant portion;

a second product line including a first expansion valve, the second product line configured to expand the second product portion to form a second product; and a refrigerant loop including a second expansion valve, the refrigerant loop configured to expand the refrigerant portion and route the expanded refrigerant portion through the heat exchanger to be vaporized and subsequently recycled to the compressor.

* * * * *